US010360872B2

(12) United States Patent
Takiguchi

(10) Patent No.: US 10,360,872 B2
(45) Date of Patent: Jul. 23, 2019

(54) DISPLAY DEVICE AND METHOD OF DRIVING THE SAME

(71) Applicant: SAMSUNG DISPLAY CO., LTD., Yongin-si, Gyeonggi-do (KR)

(72) Inventor: Masahiko Takiguchi, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 47 days.

(21) Appl. No.: 15/805,169

(22) Filed: Nov. 7, 2017

(65) Prior Publication Data

US 2018/0137834 A1 May 17, 2018

(30) Foreign Application Priority Data

Nov. 14, 2016 (KR) ..... 10-2016-0151386

(51) Int. Cl.
*G09G 5/00* (2006.01)
*G09G 3/20* (2006.01)

(52) U.S. Cl.
CPC ..... *G09G 5/006* (2013.01); *G09G 3/20* (2013.01); *G09G 3/2081* (2013.01);
(Continued)

(58) Field of Classification Search
CPC ..... G09G 3/209; G09G 5/00; G09G 5/003; G09G 5/006; G09G 2310/0243;
(Continued)

(56) References Cited

U.S. PATENT DOCUMENTS 4,015,076 A * 3/1977 Ishiodori ..... H04N 5/21 348/34
4,962,426 A * 10/1990 Naoi ..... H04N 5/21 348/623

(Continued)

FOREIGN PATENT DOCUMENTS

JP H 09-200578 A 7/1997
JP 5202347 B2 6/2013
JP 2016-080950 A 5/2016

OTHER PUBLICATIONS

Translation of Japanese Pub. No. JP 2016080950 A,May 16, 2016, 17 pages.*

*Primary Examiner* — Joe H Cheng
(74) *Attorney, Agent, or Firm* — Lee & Morse, P.C.

(57) ABSTRACT

A display device includes a controller that generates first and second sub-frame image signals based on a frame image signal. The first and second sub-frame image signals respectively correspond to sub-frames. The controller includes a filter, a signal generator, and a signal output. The filter outputs a high frequency image signal, obtained by increasing a high frequency component in the frame image signal, and a low frequency image signal obtained by decreasing the high frequency component in the frame image signal. The signal generator generates an excess signal from a portion of the high frequency image signal having a grayscale value equal to or greater than a maximum allowable grayscale value. The signal output selectively outputs the first sub-frame image signal based on the excess signal and the high frequency image signal and the second sub-frame image signal based on the excess signal and the low frequency image signal.

20 Claims, 14 Drawing Sheets

(52) U.S. Cl.
CPC ..... *G09G 3/2022* (2013.01); *G09G 2310/027* (2013.01); *G09G 2310/0243* (2013.01); *G09G 2310/0267* (2013.01); *G09G 2320/0247* (2013.01); *G09G 2320/0252* (2013.01); *G09G 2320/0266* (2013.01); *G09G 2320/066* (2013.01); *G09G 2340/0435* (2013.01); *G09G 2360/16* (2013.01); *G09G 2370/08* (2013.01)

(58) Field of Classification Search
CPC ..... G09G 2310/0267; G09G 2310/027; G09G 2320/0252; G09G 2320/0266; G09G 2320/066; G09G 2370/08
See application file for complete search history.

(56) References Cited

U.S. PATENT DOCUMENTS 5,828,366 A 10/1998 Hurst
5,892,551 A * 4/1999 Uematsu ..... H04N 5/21 348/447
6,898,327 B1 * 5/2005 Hrusecky ..... H04N 7/0132 348/606
7,466,364 B2 * 12/2008 Wischermann ..... H04N 5/21 348/447
7,697,067 B2 * 4/2010 Lim ..... H04N 5/10 348/512
8,077,258 B2 * 12/2011 Take ..... G09G 3/20 348/448
8,749,708 B2 6/2014 Kobayashi
9,483,973 B2 * 11/2016 Kimura ..... G09G 3/2074
2006/0227249 A1 * 10/2006 Chen ..... G09G 3/20 348/631
2009/0073192 A1 * 3/2009 Kobayashi ..... G09G 3/3614 345/643
2009/0310018 A1 * 12/2009 Sakashita ..... G09G 3/3614 348/448
2010/0303374 A1 * 12/2010 Mizuno ..... G06T 3/4053 382/260
2011/0007213 A1 * 1/2011 Kobayashi ..... H04N 7/0112 348/470

* cited by examiner

DISPLAY DEVICE AND METHOD OF DRIVING THE SAME

CROSS-REFERENCE TO RELATED APPLICATION

Korean Patent Application No. 10-2016-0151386, filed on Nov. 14, 2016, and entitled, "Display Device And Method Of Driving The Same," is incorporated by reference herein in its entirety.

BACKGROUND

1. Field

One or more embodiments described herein relate to a display device and a method for driving a display device.

2. Description of the Related Art

An image represented by a digital image signal (e.g., an image signal) may have inter-frame noise generated as a result of quantization in a compression process. Various attempts have been made to reduce the inter-frame noise.

One approach involves attempting to reduce noise based on flatness calculated from an image signal. When inter-frame noise is reduced by taking flatness into account, imaging noise caused by an imaging device, analog transmission noise, and/or other types of noise may be reduced. However, this approach may generate an afterimage on motion images.

Another approach involves attempting to reduce noise by performing motion adaptive processing on a stop region. In this case, the motion adaptive processing involves fixing a feedback coefficient of a first-order infinite impulse response filter, and then limiting the differential between an input image (an image of a current frame) and an output image. However, this approach may cause inter-frame noise to have a larger amplitude at a region of an image that includes an edge or texture.

SUMMARY

In accordance with one or more embodiments, a display device includes a display panel including a plurality of pixels; and a controller to receive a frame image signal corresponding to one frame and generate a first sub-frame image signal and a second sub-frame image signal to drive the display panel, the first sub-frame image signal and a second sub-frame image signal respectively corresponding to sub-frames divided from the one frame based on the frame image signal The controller includes a filter to output a high frequency image signal and a low frequency image signal, the high frequency image signal to be obtained by increasing a high frequency component in the frame image signal and the low frequency image signal to be obtained by decreasing the high frequency component in the frame image signal; an excess signal generator to generate an excess signal from a portion of the high frequency image signal, in which a grayscale value is equal to or greater than a maximum allowable grayscale value, in the high frequency image signal; and a signal outputter to selectively output the first sub-frame image signal based on the excess signal and the high frequency image signal and the second sub-frame image signal based on the excess signal and the low frequency image signal.

The excess signal may have a grayscale obtained by subtracting the maximum allowable grayscale value from the grayscale value of the portion of the high frequency image signal. The excess signal generator may multiply the high frequency image signal by a conversion constant and generate a high frequency intermediate signal such that a greatest grayscale value of the portion of the high frequency image signal becomes equal to the maximum allowable grayscale value, and the excess signal is obtained by subtracting the high frequency intermediate signal from the high frequency image signal.

The controller may include a subtractor to subtract the excess signal from the high frequency image signal to generate a high frequency intermediate signal; and an adder to add the excess signal to the low frequency image signal to generate a low frequency intermediate signal, wherein the signal outputter is to output the first sub-frame image signal based on the high frequency intermediate signal and output the second sub-frame image signal based on the low frequency intermediate signal.

The controller may include a contrast calculator to calculate a contrast of the frame image signal based on the high frequency intermediate signal and the low frequency intermediate signal; and a flatness calculator to calculate a flatness of the high frequency intermediate signal.

The signal outputter may include a critical look-up table to store a critical contrast value corresponding to the flatness, a correction signal generator to generate a correction signal based on the excess signal and the critical contrast value corresponding to the flatness of the high frequency intermediate signal when the contrast of the frame image signal is greater than the critical contrast value stored in the critical look-up table and corresponding to the flatness of the high frequency intermediate signal, and an output to subtract the excess signal and the correction signal from the high frequency image signal to generate the first sub-frame image signal, and to add the excess signal and the correction signal to the low frequency image signal to generate the second sub-frame image signal.

The correction signal generator may generate the correction signal by the following formula:

$$\beta = \frac{H - L - (H + L)Clim - 2\alpha}{2},$$

where β denotes the correction signal, H denotes the high frequency image signal, L denotes the low frequency image signal, Clim denotes the critical contrast corresponding to the flatness of the high frequency intermediate signal, and a denotes the excess signal.

The contrast calculator may calculate the contrast of the frame image signal by the following formula:

$$C = \frac{(H - \alpha) - (L + \alpha)}{(H - \alpha) + (L + \alpha)},$$

where C denotes the contrast of the frame image signal, H denotes the high frequency image signal, L denotes the low frequency image signal, and a denotes the excess signal.

The flatness of the high frequency intermediate signal may correspond to a number of pixels, among the plurality of pixels, in which a grayscale value of the high frequency intermediate signal is equal to or smaller than a predetermined reference value.

The controller may include a subtractor to subtract the excess signal from the high frequency image signal to generate a high frequency intermediate signal; an adder to add the excess signal to the low frequency image signal to generate a low frequency intermediate signal; a contrast calculator to calculate a contrast of the frame image signal based on the high frequency intermediate signal and the low frequency intermediate signal; and a flatness calculator to calculate a flatness of the high frequency intermediate signal.

The signal outputter may include a critical look-up table to store a critical contrast value corresponding to the flatness, a correction signal generator to generate a correction signal based on the excess signal and the critical contrast value corresponding to the flatness of the high frequency intermediate signal when the contrast of the frame image signal is greater than the critical contrast value, stored in the critical look-up table, corresponding to the flatness of the high frequency intermediate, a filter to output a filtering signal obtained by low-pass filtering a signal obtained by adding the excess signal and the correction signal, and an output to subtract the filtering signal from the high frequency image signal to generate the first sub-frame image signal and add the filtering signal to the low frequency image signal to generate the second sub-frame image signal.

In accordance with one or more other embodiments, a method for driving a display device includes receiving a frame image signal corresponding to one frame; and generating a first sub-frame image signal and a second sub-frame image signal to drive a display panel including a plurality of pixels, the first sub-frame image signal and the second sub-frame image respectively corresponding to sub-frames divided from the one frame based on the frame image signal.

Generating the first sub-frame image signal and the second sub-frame image signal includes increasing a high frequency component in the frame image signal to output a high frequency image signal; decreasing the high frequency component in the frame image signal to output a low frequency image signal; generating an excess signal from a portion of the high frequency image signal, in which a grayscale value is equal to or greater than a maximum allowable grayscale value, in the high frequency image signal; outputting the first sub-frame image signal based on the excess signal and the high frequency image signal; and outputting the second sub-frame image signal based on the excess signal and the low frequency image signal. The excess signal may have a grayscale obtained by subtracting the maximum allowable grayscale value from the grayscale value of the portion of the high frequency image signal.

Generating the first sub-frame image signal and the second sub-frame image signal may include multiplying the high frequency image signal by a conversion constant and generating a high frequency intermediate signal, such that the greatest grayscale value of the portion of the high frequency image signal becomes equal to the maximum allowable grayscale value, and the excess signal is obtained by subtracting the high frequency intermediate signal from the high frequency image signal.

Generating the first sub-frame image signal and the second sub-frame image signal may include subtracting the excess signal from the high frequency image signal to generate a high frequency intermediate signal; and adding the excess signal to the low frequency image signal to generate a low frequency intermediate signal, wherein the first sub-frame image signal is output based on the high frequency intermediate signal in outputting the first sub-frame image signal based on the excess signal and the high frequency image signal, and wherein the second sub-frame image signal is output based on the low frequency intermediate signal in outputting the second sub-frame image signal based on the excess signal and the low frequency image signal.

Generating the first sub-frame image signal and the second sub-frame image signal may include calculating a contrast of the frame image signal based on the high frequency intermediate signal and the low frequency intermediate signal; calculating a flatness of the high frequency intermediate signal; and generating a correction signal based on the excess signal and a critical contrast corresponding to the flatness of the high frequency intermediate signal when the contrast of the frame image signal is greater than the critical contrast corresponding to the flatness of the high frequency intermediate signal in a critical look-up table.

The first sub-frame image signal may be output by subtracting the excess signal and the correction signal from the high frequency image signal in the outputting of the first sub-frame image signal based on the excess signal and the high frequency image signal, and the second sub-frame image signal may be output by adding the excess signal and the correction signal to the low frequency image signal in the outputting of the second sub-frame image signal based on the excess signal and the low frequency image signal.

The correction signal may be generated by the following formula:

$$\beta = \frac{H - L - (H + L)Clim - 2\alpha}{2},$$

where β denotes the correction signal, H denotes the high frequency image signal, L denotes the low frequency image signal, Clim denotes the critical contrast corresponding to the flatness of the high frequency intermediate signal, and a denotes the excess signal.

The contrast of the frame image signal is calculated by the following formula:

$$C = \frac{(H - \alpha) - (L + \alpha)}{(H - \alpha) + (L + \alpha)},$$

where C denotes the contrast of the frame image signal, H denotes the high frequency image signal, L denotes the low frequency image signal, and a denotes the excess signal.

The first sub-frame image signal and the second sub-frame image signal may include subtracting the excess signal from the high frequency image signal to generate a high frequency intermediate signal; adding the excess signal to the low frequency image signal to generate a low frequency intermediate signal; calculating a contrast of the frame image signal based on the high frequency intermediate signal and the low frequency intermediate signal; calculating a flatness of the high frequency intermediate signal; generating a correction signal based on the excess signal and a critical contrast corresponding to the flatness of the high frequency intermediate signal when the contrast of the frame image signal is greater than the critical contrast corresponding to the flatness of the high frequency intermediate signal in a critical look-up table storing the critical contrast corresponding to the flatness; and outputting a filtering signal obtained by low-pass filtering a signal obtained by adding the excess signal and the correction signal.

The first sub-frame image signal may be obtained by subtracting the filtering signal from the high frequency image signal is output in the outputting of the first sub-frame image signal based on the excess signal and the high frequency image signal, and the second sub-frame image signal may be obtained by adding the filtering signal to the low frequency image signal is output in the outputting of the second sub-frame image signal based on the excess signal and the low frequency image signal.

In accordance with one or more other embodiments, a method for driving a display device includes receiving a frame image signal corresponding to one frame; and generating a first sub-frame image signal and a second sub-frame image signal to drive a display panel including a plurality of pixels, the first sub-frame image signal and the second sub-frame image signal respectively corresponding to sub-frames divided from the one frame based on the frame image signal.

Generating of the first sub-frame image signal and the second sub-frame image signal may include increasing a high frequency component in the frame image signal to output a high frequency image signal; decreasing the high frequency component in the frame image signal to output a low frequency image signal; calculating a contrast of the frame image signal based on the high frequency image signal and the low frequency image signal; calculating a flatness of the high frequency image signal; generating a correction signal based on a critical contrast corresponding to the flatness of the high frequency image signal when the contrast of the frame image signal is greater than the critical contrast corresponding to the flatness of the high frequency image signal in a critical look-up table storing the critical contrast corresponding to the flatness; and outputting the first sub-frame image signal based on the correction signal and the high frequency image signal; and outputting the second sub-frame image signal based on the correction signal and the low frequency image signal.

Generating the first sub-frame image signal and the second sub-frame image signal may include generating an excess signal from a portion of a correction subtraction signal, in which a grayscale value is equal to or greater than a maximum allowable grayscale value, obtained by subtracting the correction signal from the high frequency image signal, wherein the first sub-frame image signal is obtained by subtracting the correction signal and the excess signal from the high frequency image signal output based on the correction signal and the high frequency image signal, and wherein the second sub-frame image signal is obtained by adding the correction signal and the excess signal to the low frequency image signal output based on the correction signal and the low frequency image signal.

Generating the first sub-frame image signal and the second sub-frame image signal may include outputting a filtering signal obtained by low-pass filtering a signal obtained by adding the excess signal and the correction signal, wherein the first sub-frame image signal is obtained by subtracting the filtering signal from the high frequency image signal output based on the correction signal and the high frequency image signal, and wherein the second sub-frame image signal obtained by adding the filtering signal to the low frequency image signal output based on the correction signal and the low frequency image signal.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
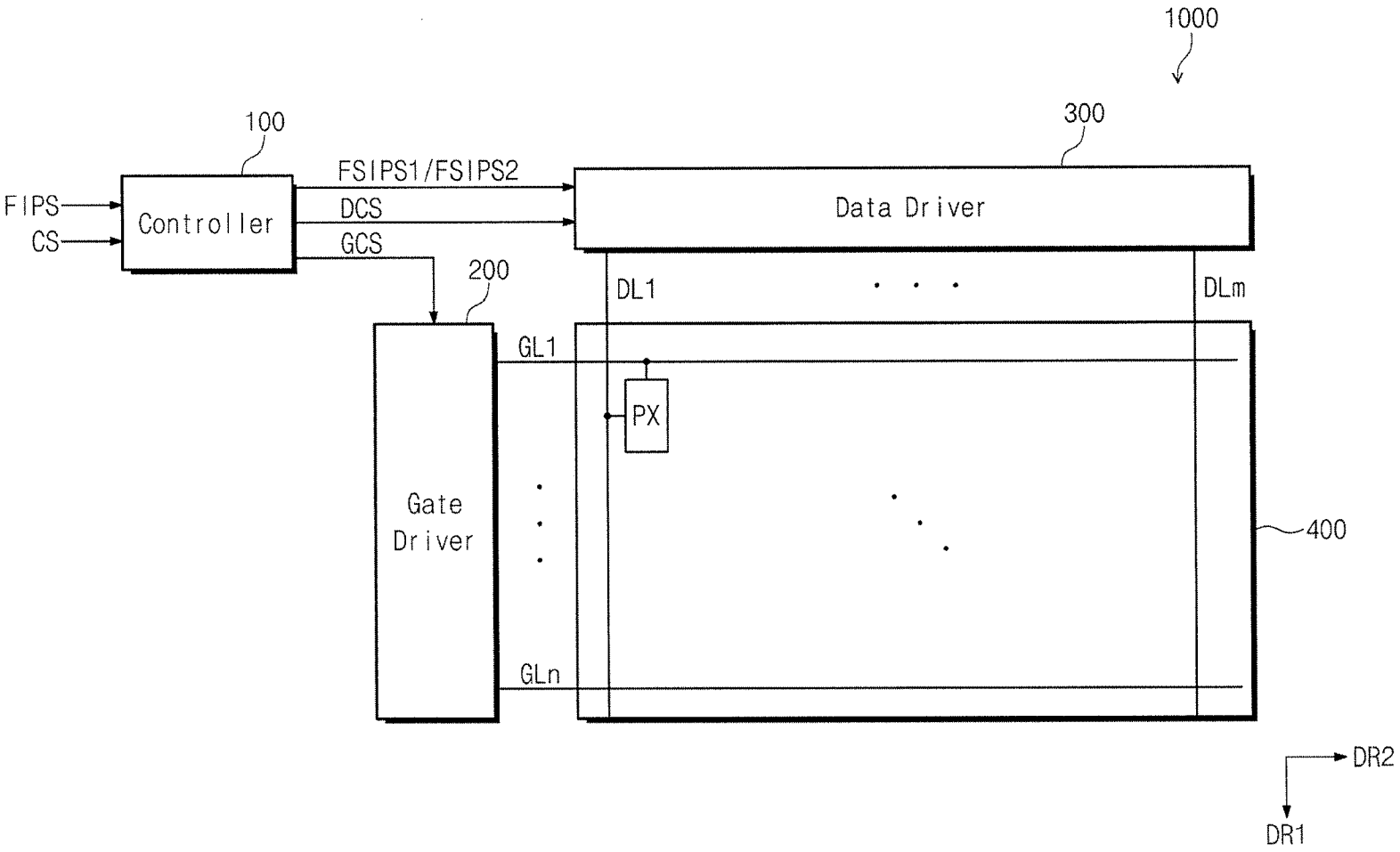
FIG. 1 illustrates an embodiment of a display device.

Example embodiments are described with reference to the drawings; however, they may be embodied in different forms and should not be construed as limited to the embodiments set forth herein. Rather, these embodiments are provided so that this disclosure will be thorough and complete, and will convey exemplary implementations to those skilled in the art. The embodiments (or portions thereof) may be combined to form additional embodiments In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of a display device 1000 which includes a display panel 400 for displaying an image, gate and data drivers 200 and 300 for driving the display panel 400, and a controller 100 for controlling a drive of the gate and data drivers 200 and 300.

The controller 100 receives a frame image signal FIPS and a plurality of control signals CS, for example, from an external source. The controller 100 converts a data format of the frame image signal FIPS to a data format appropriate to an interface between the data driver 300 and the controller 100, in order to generate a first sub-frame image signal FSIPS1 and a second sub-frame image signal FSIPS2. The first sub-frame image signal FSIPS1 and the second sub-frame image signal FSIPS2 are then applied to the data driver 300.

In addition, the controller 100 generates a data control signal DCS (e.g., an output start signal, a horizontal start signal, etc., and a gate control signal GCS, e.g., a vertical start signal, a vertical clock signal, a vertical clock bar signal, etc.) based on the control signals CS. The data control signal DCS is applied to the data driver 300, and the gate control signal GCS is applied to the gate driver 200.

The gate driver 200 sequentially outputs gate signals based on the gate control signal GCS from the controller 100.

The data driver 300 converts the first sub-frame image signal FSIPS1 and the second sub-frame image signal FSIPS2 to data voltages based on the data control signal DCS from the controller 100 and outputs the data voltages. The data voltages are applied to the display panel 400.

The display panel 400 includes a plurality of gate lines GL1 to GLn, a plurality of data lines DL1 to DLm, and a plurality of pixels PX arranged in a matrix form. For convenience of explanation, FIG. 1 shows one representative pixel PX. The pixels PX may emit light of different colors. e.g., red, green, and blue or another combination of colors.

The gate lines GL1 to GLn extend in a second direction DR2 and are arranged to be substantially parallel to each other in a first direction DR1, which is substantially vertical to the second direction DR2. The gate lines GL1 to GLn are connected to the gate driver 200 to receive the gate signals from the gate driver 200.

The data lines DL1 to DLm extend in the first direction DR1 and are arranged to be substantially parallel to each other in the second direction DR2. The data lines DL1 to DLm are connected to the data driver 300 in order to receive the data voltages from the data driver 300. Each of the pixels PX is connected to a corresponding one of the gate lines GL1 to GLn and a corresponding one of the data lines DL1 to DLm.

Figure 2:
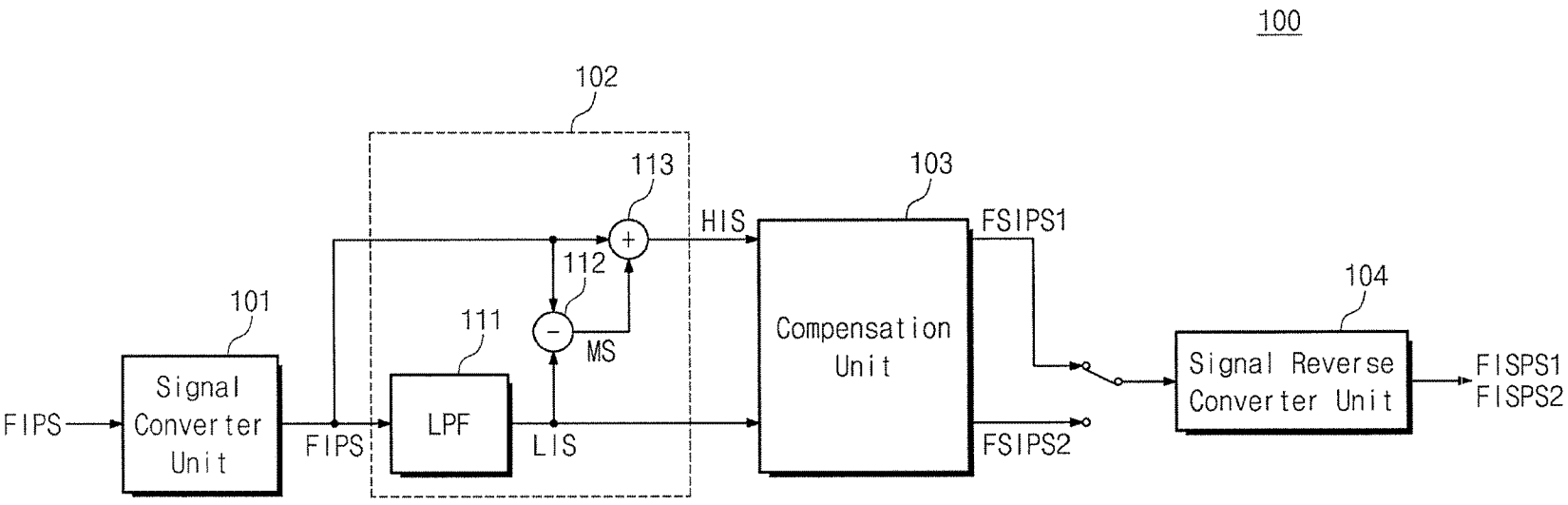
FIG. 2 illustrates an embodiment of a controller.
Figure 3A:
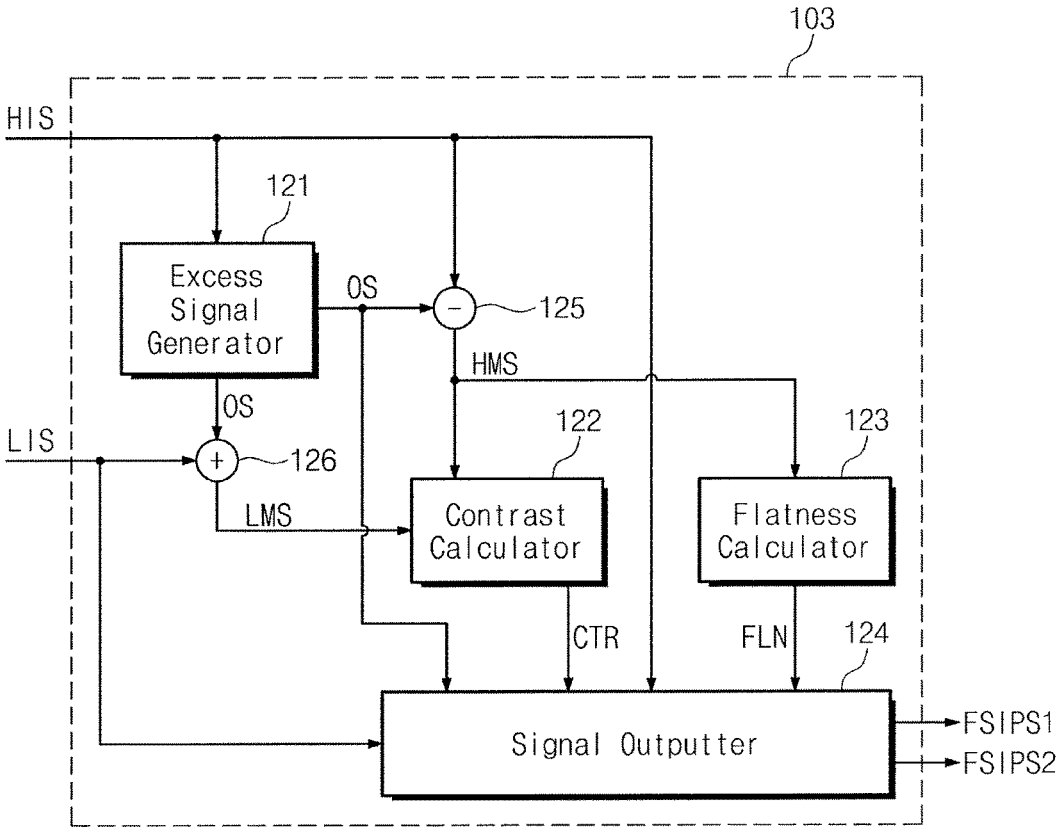
FIG. 3A illustrates an embodiment of a correction unit.
Figure 3B:
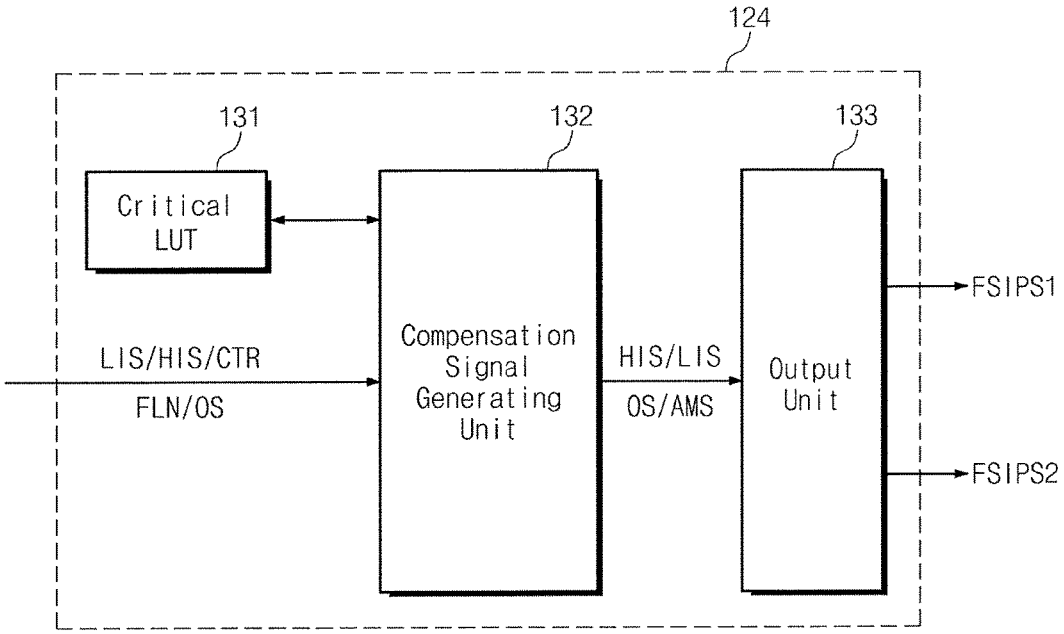
FIG. 3B illustrates an embodiment of a signal outputter.
Figure 4A:
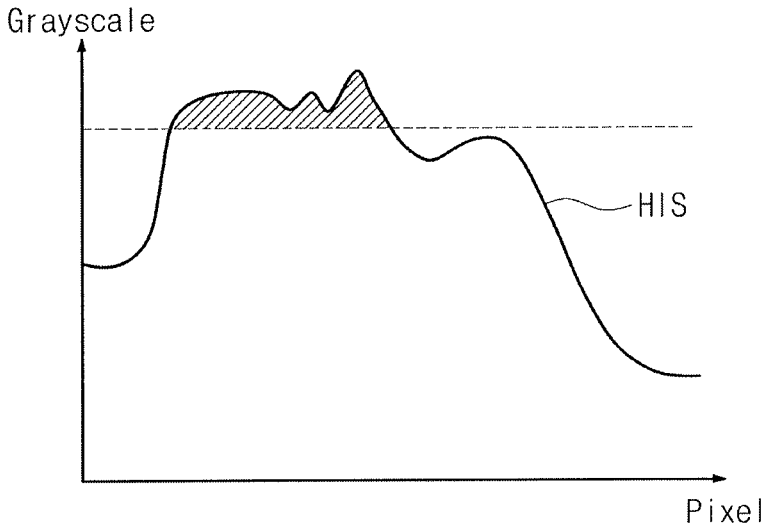
FIG. 4A illustrates an example of a graph showing an excess signal.
Figure 4B:
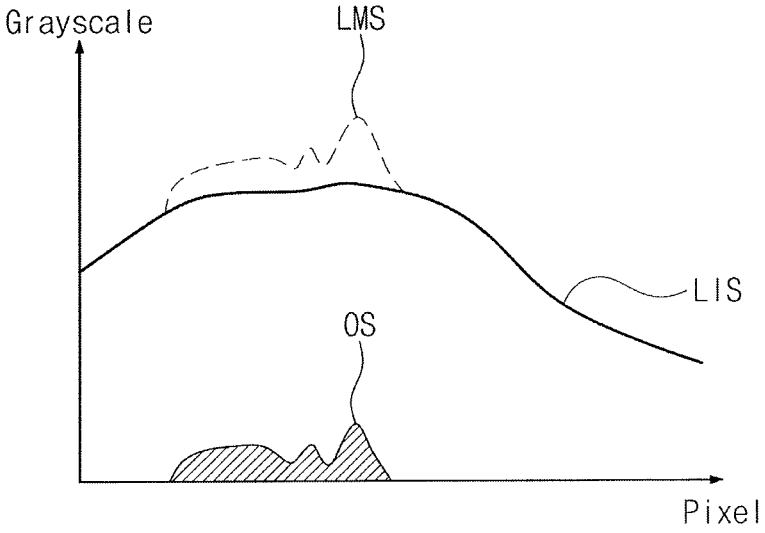
FIG. 4B illustrates an example of a graph showing a low frequency intermediate signal.
Figure 4C:
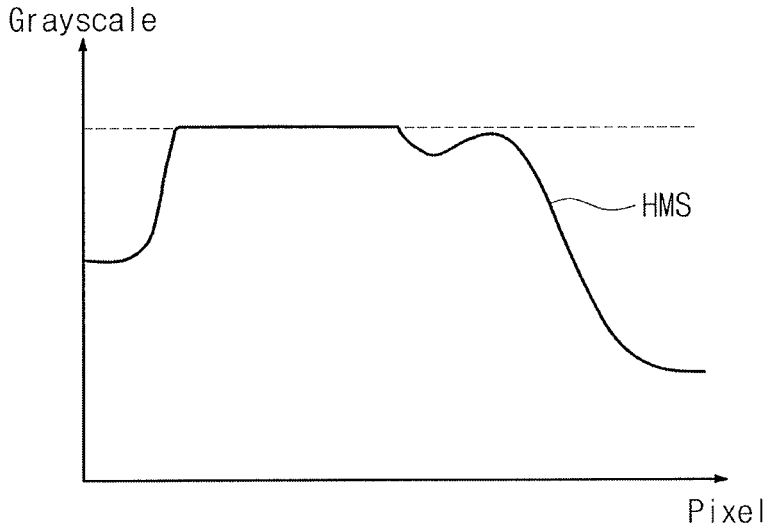
FIG. 4C illustrates an example of a graph showing a high frequency intermediate signal.
Figure 5A:
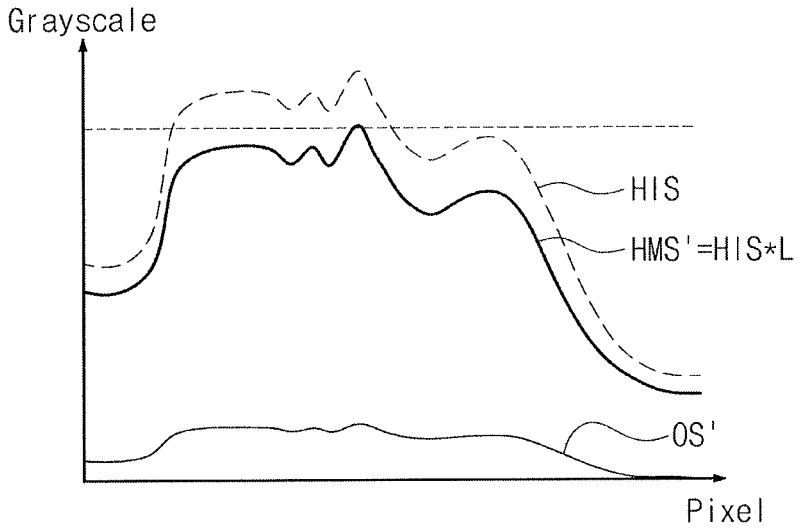
FIG. 5A illustrates another example of a graph showing an excess signal and a high frequency intermediate signal.
Figure 5B:
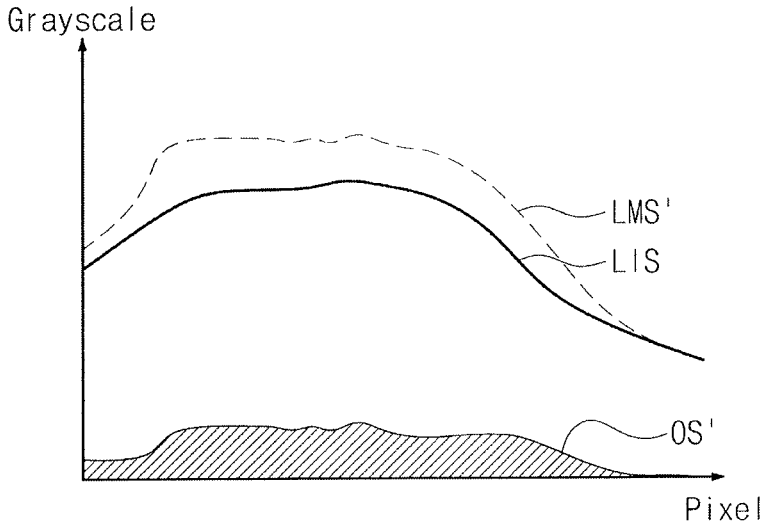
FIG. 5B illustrates another example of a graph showing a low frequency intermediate signal.

FIG. 2 illustrates an embodiment of the controller 100. FIG. 3A illustrates an embodiment of a correction unit 103, and FIG. 3B illustrates an embodiment of a signal outputter 124. FIG. 4A illustrates an embodiment of an excess signal OS, FIG. 4B illustrates an example of a graph showing a low frequency intermediate signal LMS, and FIG. 4C illustrate an example of a graph showing a high frequency intermediate signal HMS. FIG. 5A illustrates another example of a graph showing an excess signal OS and a high frequency intermediate signal HMS, and FIG. 5B illustrates another example of a graph showing a low frequency intermediate signal LMS.

Referring to FIG. 2, the controller 100 includes a signal converter unit 101, a filter unit 102, a correction unit 103, and a signal reverse converter unit 104. The signal converter unit 101 may gamma-convert the frame image signal FIPS, for example, from an external source. The signal converter unit 101 may convert, for example, the frame image signal FIPS to the form of brightness signal including brightness data from the form of electronic signal.

The controller 100 may include a frame converter for increasing a frame frequency of the frame image signal FIPS. As a result, one frame is divided into a plurality of sub-frames. For example, a first sub-frame image signal FSIPS1 and a second sub-frame image signal FSIPS2 may be generated to respectively correspond to the sub-frames. In one embodiment, three or more sub-frames may be provided. Thus, one or more additional sub-frame image signals may be generated besides the first sub-frame image signal FSIPS1 and the second sub-frame image signal FSIPS2.

The filter unit 102 may include a filter 111, a subtractor 112, and an adder 113. The filter 111 may receive the frame image signal FIPS and may include a low pass filter LPF. As an example, the filter 111 may receive the frame image signal FIPS and output a low frequency image signal LIS, after reducing a high frequency component in the frame image signal FIPS. The low frequency image signal LIS and the frame image signal FIPS may be input to the subtractor 112.

The subtractor 112 may output a subtraction signal MS obtained by subtracting the low frequency image signal LIS from the frame image signal FIPS to the adder 113.

The adder 113 may receive the frame image signal FIPS and the subtraction signal MS. The adder 113 adds the frame image signal FIPS to the subtraction signal MS to output a high frequency image signal HIS.

The correction unit 103 may receive the low frequency image signal LIS and the high frequency image signal HIS. The correction unit 103 corrects the low frequency image signal LIS and the high frequency image signal HIS and selectively outputs the first sub-frame image signal FSIPS1 and the second sub-frame image signal FSIPS2 to the signal reverse converter unit 104.

The signal reverse converter unit 104 converts the first sub-frame image signal FSIPS1 and the second sub-frame image signal FSIPS2 to the form of electronic signal, and selectively outputs the first sub-frame image signal FSIPS1 and the second sub-frame image signal FSIPS2 to the data driver 300 (e.g., refer to FIG. 1).

Referring to FIG. 3A, the correction unit 103 includes an excess signal generator 121, a subtractor 125, an adder 126, a contrast calculator 122, a flatness calculator 123, and a signal outputter 124. The excess signal generator 121 may receive the high frequency image signal HIS. The excess signal generator 121 may generate the excess signal OS from a portion of the high frequency image signal HIS, in which a grayscale value is equal to or greater than a maximum allowable grayscale value, in the high frequency image signal HIS.

In FIG. 4A, the X-axis represents the pixel and the Y-axis represents the grayscale value of the image signal. This is also the case in FIGS. 4B, 4C, 5A, and 5B.

Some grayscale values of the high frequency image signal HIS may exceed the maximum allowable grayscale value. For instance, the maximum allowable grayscale value of the image signal may be, but not limited to, about 255 grayscale. In this case, some grayscale values of the high frequency image signal HIS may exceed the 255 grayscale as shown in FIG. 4A. The grayscale values of the high frequency image signal HIS exceeding the 255 grayscale may correspond to some of the pixels. For example, the grayscale value of the excess signal OS may be obtained by subtracting the maximum allowable grayscale value from the grayscale values exceeding the maximum allowable grayscale value in the high frequency image signal HIS.

Consequently, the excess signal generator 121 may generate the excess signal OS using a portion of the high frequency image signal HIS, which exceeds the 255 grayscale. The excess signal OS may be a signal corresponding to a portion given by hatched diagonal lines in FIG. 4B.

The adder 126 adds the low frequency image signal LIS and the excess signal OS to generate the low frequency intermediate signal LMS. As shown in FIG. 4B, the low frequency intermediate signal LMS may be obtained by adding the excess signal OS to the low frequency image signal LIS that is represented by a solid line.

The subtractor 125 subtracts the excess signal OS from the high frequency image signal FITS to generate the high frequency intermediate signal HMS. As shown in FIG. 4C, the high frequency intermediate signal HMS may be a signal obtained by removing a portion exceeding the maximum allowable grayscale value from the high frequency image signal HIS.

In another embodiment, the excess signal OS may be generated by a different method. For instance, as shown in FIG. 5A, a high frequency intermediate signal HMS' may be generated by multiplying the high frequency image signal HIS by a conversion constant L, such that the greatest grayscale value of the portion of the high frequency image signal HIS exceeding the 255 grayscale becomes equal to the allowable grayscale value (e.g., 255 grayscale). In this case, an excess signal OS' may be obtained by subtracting the high frequency intermediate signal HMS' from the high frequency image signal HIS. A low frequency intermediate signal LMS' may be obtained by adding the excess signal OS' to the low frequency image signal LIS.

The following descriptions will be explained with respect to the excess signal OS described in FIGS. 4A to 4C, but they may be applied to the excess signal OS described in FIGS. 5A and 5B.

The contrast calculator 122 may receive the high frequency intermediate signal HMS and the low frequency intermediate signal LMS. The contrast calculator 122 may calculate a contrast CTR of the frame image signal FIPS based on the high frequency intermediate signal HMS and the low frequency intermediate signal LMS and output the calculated contrast CTR to the signal outputter 124. As an example, the contrast CTR of the frame image signal FIPS may be calculated by the following contrast (CTR) calculation formula:

Contrast (CTR) calculation formula:

$$CTR = \frac{(HIS - OS) - (LIS + OS)}{(HIS - OS) + (LIS + OS)}$$

The flatness calculator 123 may calculate a flatness FLN of the high frequency intermediate signal HMS and output the calculated flatness to the signal outputter 124. The flatness FLN of the high frequency intermediate signal HMS may be determined, for example, by the number of the pixels in which the grayscale value of the high frequency intermediate signal HMS is equal to or less than a predetermined reference value among the pixels PX (e.g., refer to FIG. 1). The reference value may be determined in various ways. For instance, the flatness FLN of the high frequency intermediate signal HMS may be determined based on a result of passing the high frequency intermediate signal HMS through a Laplacian filter.

In FIG. 3A, the flatness calculator 123 receives the high frequency intermediate signal HMS and calculates the flatness FLN of the high frequency intermediate signal HMS. In one embodiment, the flatness calculator 123 may receive the high frequency image signal HIS, calculate the flatness FLN of the high frequency image signal HMS, and output the calculated flatness FLN to the signal outputter 124.

Referring to FIG. 3B, the signal outputter 124 may include a critical look-up table 131, a correction signal generating unit 132, and an output unit 133. The critical look-up table 131 may store a critical contrast corresponding to the flatness. The critical contrast may be obtained based on the number of viewers who perceive a flicker phenomenon from a displayed image, among viewers who watch a predetermined image displayed by the display device 1000. The flatness and the contrast of the predetermined image may be varied. In this case, the number of viewers who perceive the flicker phenomenon may be varied. Through variation of the flatness and contrast, a critical value of the contrast at which all viewers do not perceive the flicker phenomenon according to the flatness may be calculated. The critical look-up table 131 may store the critical contrast value according to the flatness.

The correction signal generating unit 132 may receive the high frequency image signal HIS, the low frequency image signal LIS, the contrast CTR of the frame image signal FIPS, the flatness FLN of the high frequency intermediate signal HMS, and the excess signal OS. The correction signal generating unit 132 may generate a correction signal AMS, based on the excess signal OS and the flatness FLN of the high frequency intermediate signal HMS, when the contrast CTR of the frame image signal FIPS is greater than the critical contrast corresponding to the flatness FLN of the high frequency intermediate signal HMS in the critical look-up table 131 (e.g., a viewer who perceives the flicker phenomenon exists). For example, the correction signal generating unit 132 may generate the correction signal AMS based on the excess signal OS, the flatness FLN of the high frequency intermediate signal HMS, the high frequency image signal HIS, and the low frequency image signal LIS.

As an example, the correction signal AMS may be generated by the following correction signal calculating formula:

Correction signal calculating formula:

$$AMS = \frac{HIS - LIS - (HIS + LIS)Clim - 2OS}{2}$$

In the correction signal calculating formula, Clim may be the critical contrast corresponding to the flatness FLN of the high frequency intermediate signal HMS.

The output unit 133 may receive the high frequency image signal HIS, and the low frequency image signal LIS, the excess signal OS, and the correction signal AMS. The output unit 133 subtracts the excess signal OS and the correction signal AMS from the high frequency image signal HIS and outputs the first sub-frame image signal FSIPS1 to the signal reverse converter unit 104 (e.g., refer to FIG. 2). The excess signal OS and the correction signal AMS are added to the low frequency image signal LIS to output the second sub-frame image signal FSIPS2 to the signal reverse converter unit 104. For example, the output unit 133 may selectively output the first sub-frame image signal FSIPS1 and the second sub-frame image signal FSIPS2 to the signal reverse converter unit 104. In one embodiment, the output unit 133 may output the first sub-frame image signal FSIPS1 to the signal reverse converter unit 104 based on one of the sub-frames and may output the second sub-frame image signal FSIPS2 to the signal reverse converter unit 104 based on another one of the sub-frames.

As described above, when the frequency of the frame image signal FIPS is doubled and a spatial frequency of one frame is divided into a high frequency component and a low frequency component, a motion blur is improved, but a clip phenomenon and the flicker phenomenon may occur. However, since the high frequency intermediate signal HMS and the low frequency intermediate signal LMS are generated from the excess signal OS, the clip phenomenon may be prevented from occurring, and since the first sub-frame image signal FSIPS1 and the second sub-frame image signal FSIPS2 are generated from the correction signal AMS, the flicker phenomenon may be prevented from occurring.

Figure 6:
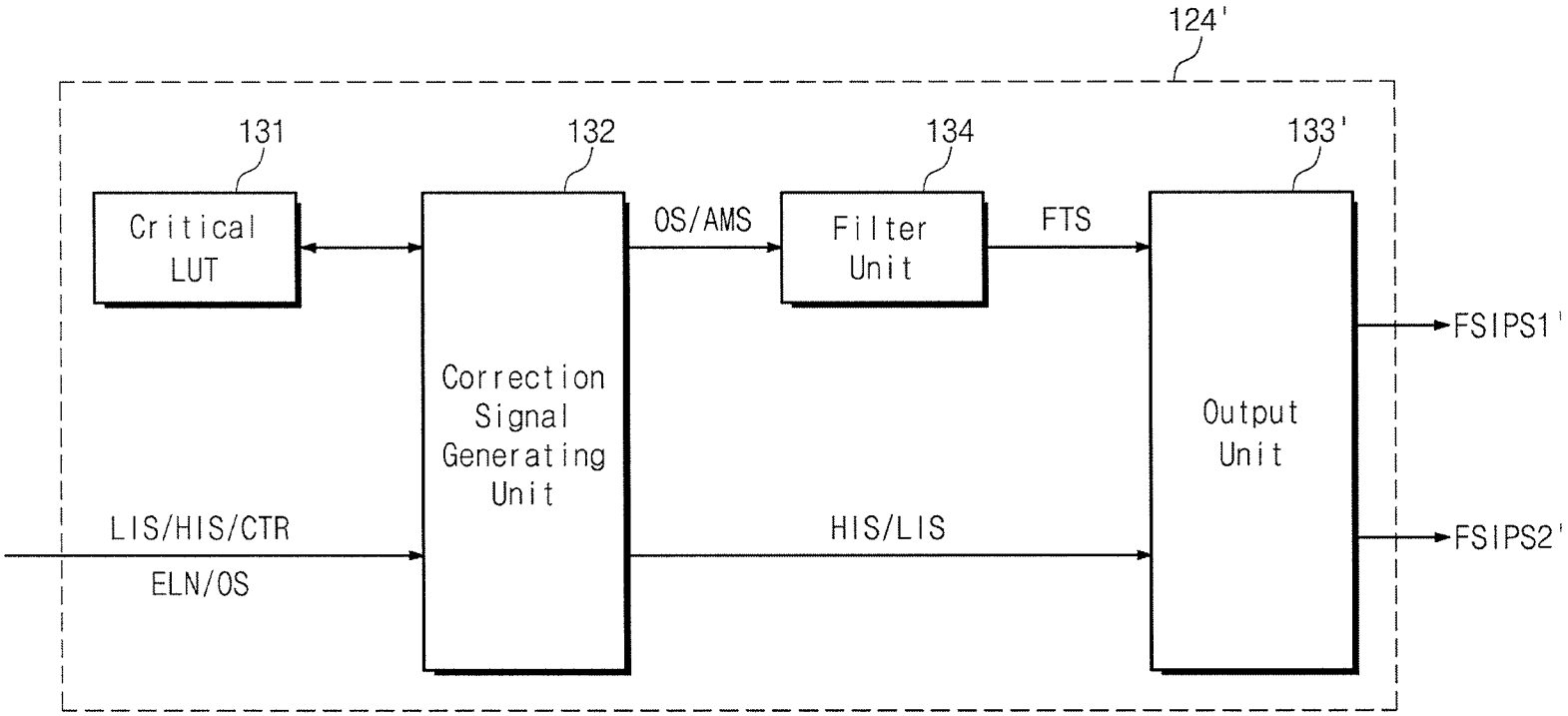
FIG. 6 illustrates another embodiment of a signal outputter.

FIG. 6 illustrates another embodiment of a signal outputter 124' which may further include a filter unit 134 compared to the signal outputter 124 shown in FIG. 3B. The filter unit 134 may receive and add an excess signal OS and a correction signal AMS. The filter unit 134 may filter the added signal. In the present exemplary embodiment, the filter unit 134 may include a low pass filter to low-pass filter the added signal to generate a filtering signal FTS. In another embodiment, the filter unit 134 may be another type of filter, e.g., the filter unit 134 may include a dither or a gain limiter.

An output unit 133' may receive a high frequency image signal HIS and a low frequency image signal LIS from a correction signal generating unit 132 and the filtering signal FTS from the filter unit 134. The output unit 133' may subtract the filtering signal FTS from the high frequency image signal HIS to output a first sub-frame image signal FSIPS1' to a signal reverse converter unit 104. The filtering signal FTS may be added to the low frequency image signal LIS to output a second sub-frame image signal FSIPS2' to the signal reverse converter unit 104.

As described above, since the signal outputter 124' further includes the filter unit 134, noise may be reduced or prevented from occurring even though the correction range of the correction signal AMS is large, e.g., above a predetermined value.

Figure 7A:
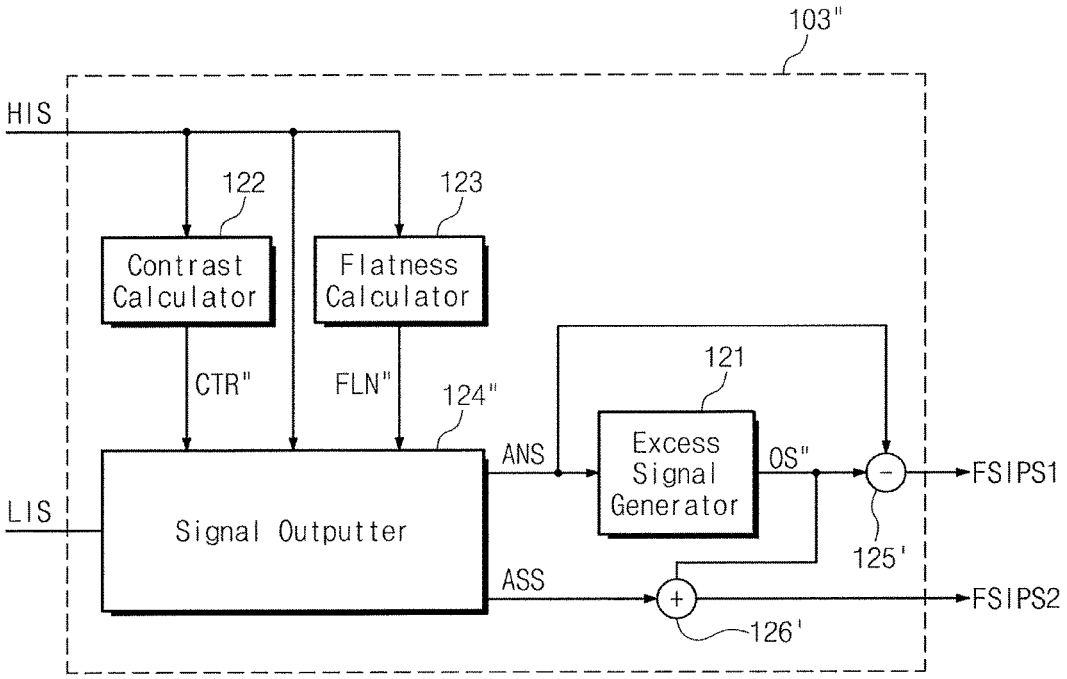
FIG. 7A illustrates another embodiment of a correction unit.
Figure 7B:
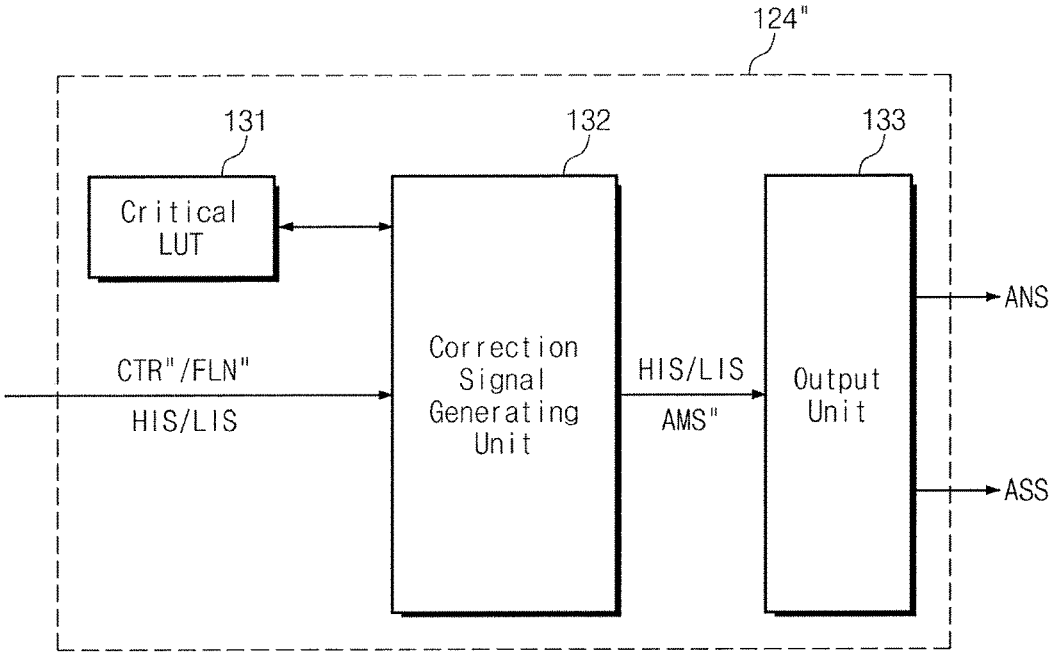
FIG. 7B illustrates another embodiment of a signal outputter.

FIG. 7A illustrates another embodiment of a correction unit 103", and FIG. 7B illustrates another embodiment of a signal outputter 124".

Referring to FIGS. 7A and 7B, a contrast calculator 122 may receive a high frequency image signal HIS and output a contrast CTR" of the high frequency image signal HIS to the signal outputter 124".

A flatness calculator 123 may receive the high frequency image signal HIS and output a flatness FLN" of the high frequency image signal HIS to the signal outputter 124".

A correction signal generating unit 132 of the signal outputter 124" may receive the contrast CTR" of the high frequency image signal HIS, the flatness FLN" of the high frequency image signal HIS, the high frequency image signal HIS, and the low frequency image signal LIS and generate a correction signal AMS" (for example, through the same method as the correction signal generating unit 132 shown in FIG. 3B) based on the contrast CTR" of the high frequency image signal HIS, the flatness FLN" of the high frequency image signal HIS, the high frequency image signal HIS, and the low frequency image signal LIS. The output unit 133 may output a correction subtraction signal ANS obtained by subtracting the correction signal AMS" from the high frequency image signal HIS and a correction add signal ASS obtained by adding the correction signal AMS" to the low frequency image signal LIS.

An excess signal generator 121 may receive the correction subtraction signal ANS and generate an excess signal OS", for example, through the same method as the excess signal generator 121 shown in FIG. 3A.

A subtractor 125' may receive the correction subtraction signal ANS and the excess signal OS" and may subtract the excess signal OS" from the correction subtraction signal ANS to output the first sub-frame image signal FSIPS1.

An adder 126' may receive the correction add signal ASS and the excess signal OS" and may add the excess signal OS" to the correction add signal ASS to output the second sub-frame image signal FSIPS2.

As described above, when the frequency of the frame image signal FIPS is doubled and the spatial frequency of one frame is divided into the high frequency component and the low frequency component, motion blur may be improved but the clip phenomenon and the flicker phenomenon may occur. However, since the excess signal OS" is generated, the clip phenomenon may be prevented from occurring. Also, since the first sub-frame image signal FSIPS1 and the second sub-frame image signal FSIPS2 are generated from the correction signal AMS" and the excess signal OS", the flicker phenomenon may be prevented.

Figure 8:
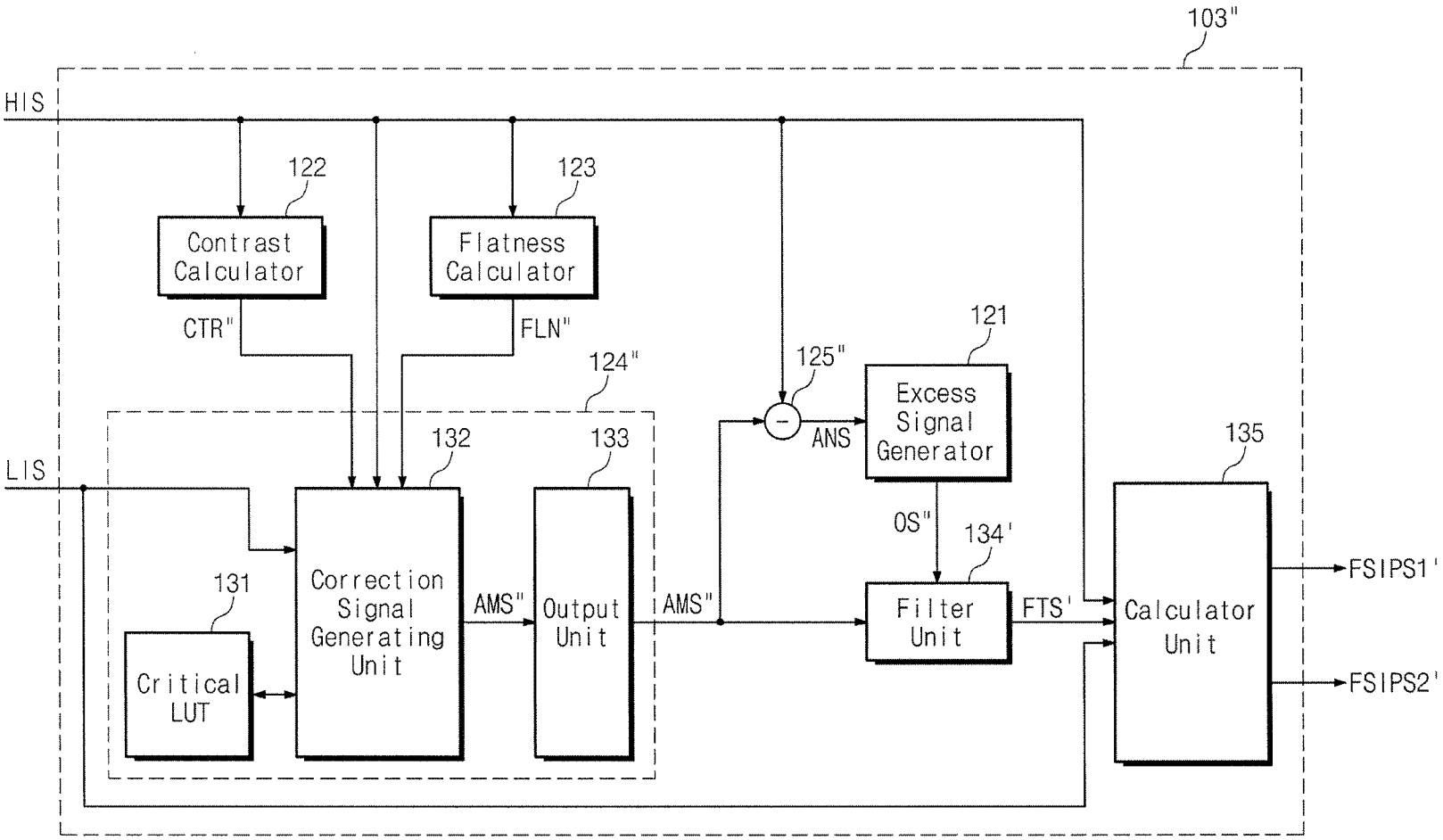
FIG. 8 illustrates another embodiment of a correction unit.

FIG. 8 illustrates another embodiment of a correction unit 103" which may further include a filter unit 134' and a calculator unit 135. A correction signal generating unit 132 of a signal outputter 124" may receive a low frequency image signal LIS, a high frequency image signal HIS, a contrast CTR" of the high frequency image signal HIS, and a flatness FLN" of the high frequency image signal HIS and generate a correction signal AMS", for example, through the same way as the correction signal generating unit 132 shown in FIG. 7B. An output unit 133 may output the correction signal AMS" to a subtractor 125". For example, the signal outputter 124" may output the correction signal AMS" to the subtractor 125". The subtractor 125" may receive the high frequency image signal HIS and the correction signal AMS" and may output a correction subtraction signal ANS (obtained by subtracting the correction signal AMS" from the high frequency image signal HIS) to an excess signal generator 121.

The excess signal generator 121 may receive the correction subtraction signal ANS and output an excess signal OS" to the filter unit 134' (for example, through the same way as the excess signal generator 121 shown in FIG. 7A) based on the correction subtraction signal ANS.

The filter unit 134' may receive and add the excess signal OS" and the correction signal AMS". The filter unit 134' may filter the added signal. In the present exemplary embodiment, the filter unit 134' may include a low pass filter to low-pass filter the added signal to generate a filtering signal FTS. In another embodiment, the filter unit 134 may be different, e.g., the filter unit 134' may include a dither or a gain limiter.

The calculator unit 135 may receive the high frequency image signal HIS, the low frequency image signal LIS, and the filtering signal FTS'. The calculator unit 135 may subtract the filtering signal FTS' from the high frequency image signal HIS to output a first sub-frame image signal FSIPS1' to the signal reverse converter unit 104, and add the filtering signal FTS' to the low frequency image signal LIS to output a second sub-frame image signal FSIPS2' to the signal reverse converter unit 104.

As described above, since the correction unit 103" further includes the filter unit 134', noise may be reduced or prevented from occurring even though a range in correction by the correction signal AMS" is large.

Figure 9:
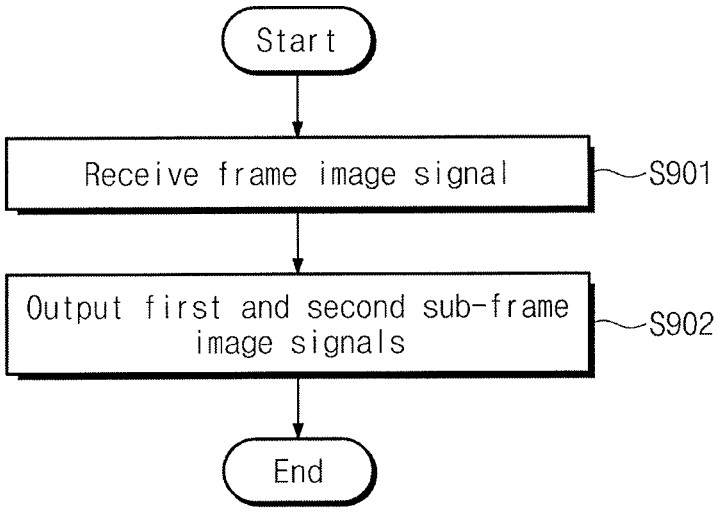
FIG. 9 illustrates an embodiment of a method for driving a display device.

FIG. 9 illustrates an embodiment of a method for driving the display device, which, for example, may be any of the embodiments of the display device 1000 described herein.

Referring to FIGS. 1 and 9, according to this method the controller 100 may receive the frame image signal FIPS (S901). Then, the controller 100 may generate the first sub-frame image signal FSIPS1 and the second sub-frame image signal FSIPS2 respectively corresponding to sub-frames divided from one frame based on the frame image signal FIPS. The controller 100 may then selectively output the first sub-frame image signal FSIPS1 and the second sub-frame image signal FSIPS2 (S902).

Figure 10:
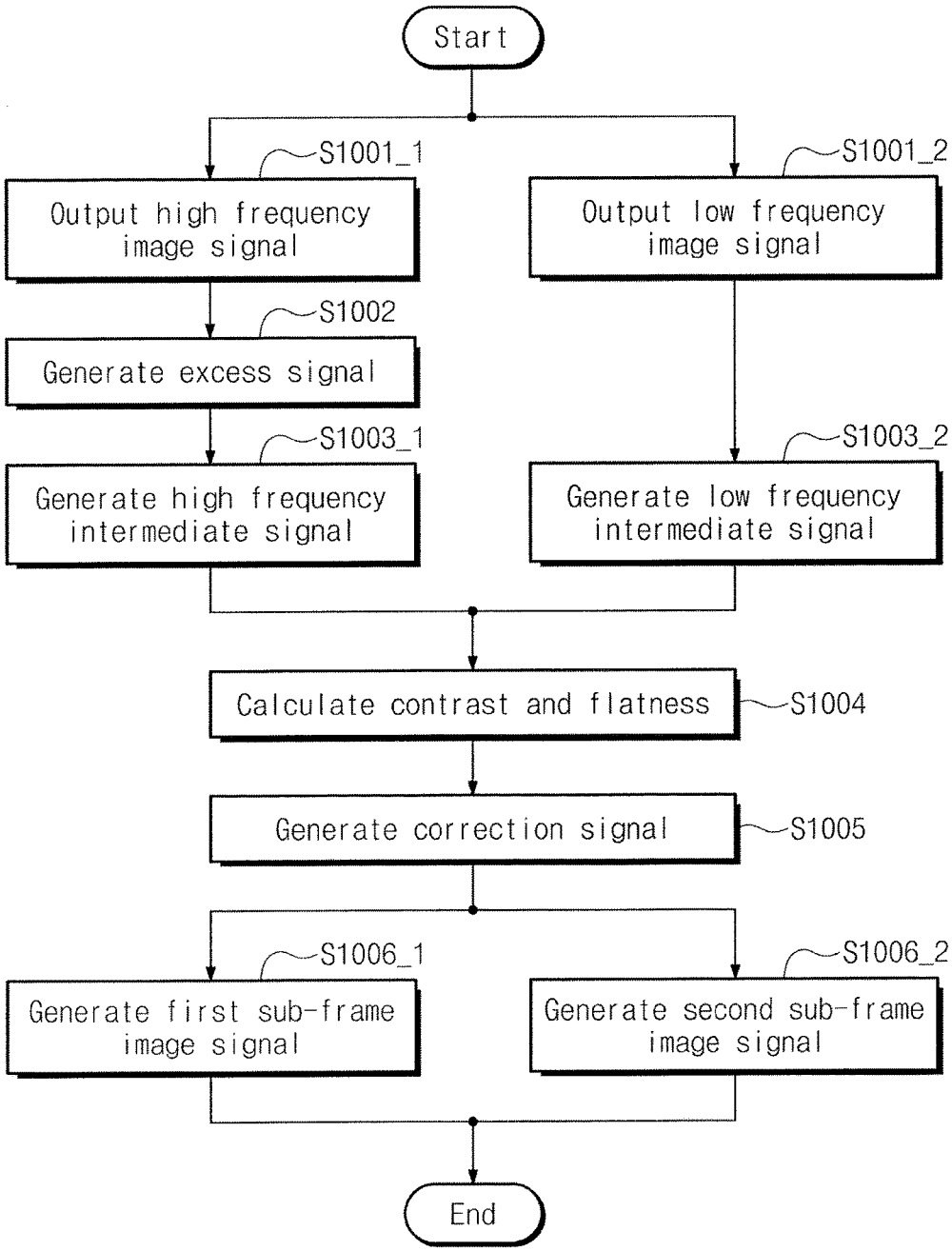
FIG. 10 illustrates an embodiment for outputting first and second sub-frame image signals.

FIG. 10 illustrates an embodiment for outputting of the first and second sub-frame image signals FSIPS1 and FSIPS2. Referring to FIGS. 2, 3A, 3B, and 10, the high frequency image signal HIS and the low frequency image signal LIS may be output through the filter unit 102 (S1001_1 and S1001_2). Then, the excess signal generating unit 121 may generate the excess signal OS from the high frequency image signal HIS, in which the grayscale value is equal to or greater than the maximum allowable grayscale value, in the high frequency image signal HIS (S1002). The high frequency intermediate signal HMS obtained by subtracting the excess signal OS from the high frequency image signal HIS through the subtractor 125 may be generated (S1003_1). The low frequency intermediate signal LMS obtained by adding the excess signal OS to the low frequency image signal LIS through the adder 126 may be generated (S1003_2).

Then, the contrast calculator 122 may calculate the contrast CTR of the frame image signal FIPS based on the high frequency intermediate signal HMS and the low frequency intermediate signal LMS. The flatness calculator 123 may calculate the flatness FLN of the high frequency intermediate signal HMS (S1004). The correction signal generating unit 132 of the signal outputter 124 may generate the correction signal AMS based on the excess signal OS, the flatness of the high frequency intermediate signal HMS, the high frequency image signal HIS, and the low frequency image signal LIS (S1005).

The output unit of the signal outputter 124 may subtract the excess signal OS and the correction signal AMS from the high frequency image signal HIS and generate the first sub-frame image signal FSIPS1 (S1006_1) to output the first sub-frame image signal FSIPS1 to the signal reverse converter unit 104. The output unit of the signal outputter 124 may add the excess signal OS and the correction signal AMS to the low frequency image signal LIS and generate the second sub-frame image signal FSIPS2 (S1006_2) to output the second sub-frame image signal FSIPS2 to the signal reverse converter unit 104.

The filtering signal FTS may be generated by passing the signal obtained by adding the excess signal OS and the correction signal AMS through the low pass filter of the filter unit 134. Thus, the first sub-frame image signal FSIPS1' and the second sub-frame image signal FSIPS2' may be generated (e.g., as shown in FIG. 6) in an operation between operations S1005 and S1006_1 and between operations S1005 and S1006_2 in the flowchart shown in FIG. 10.

Figure 11:
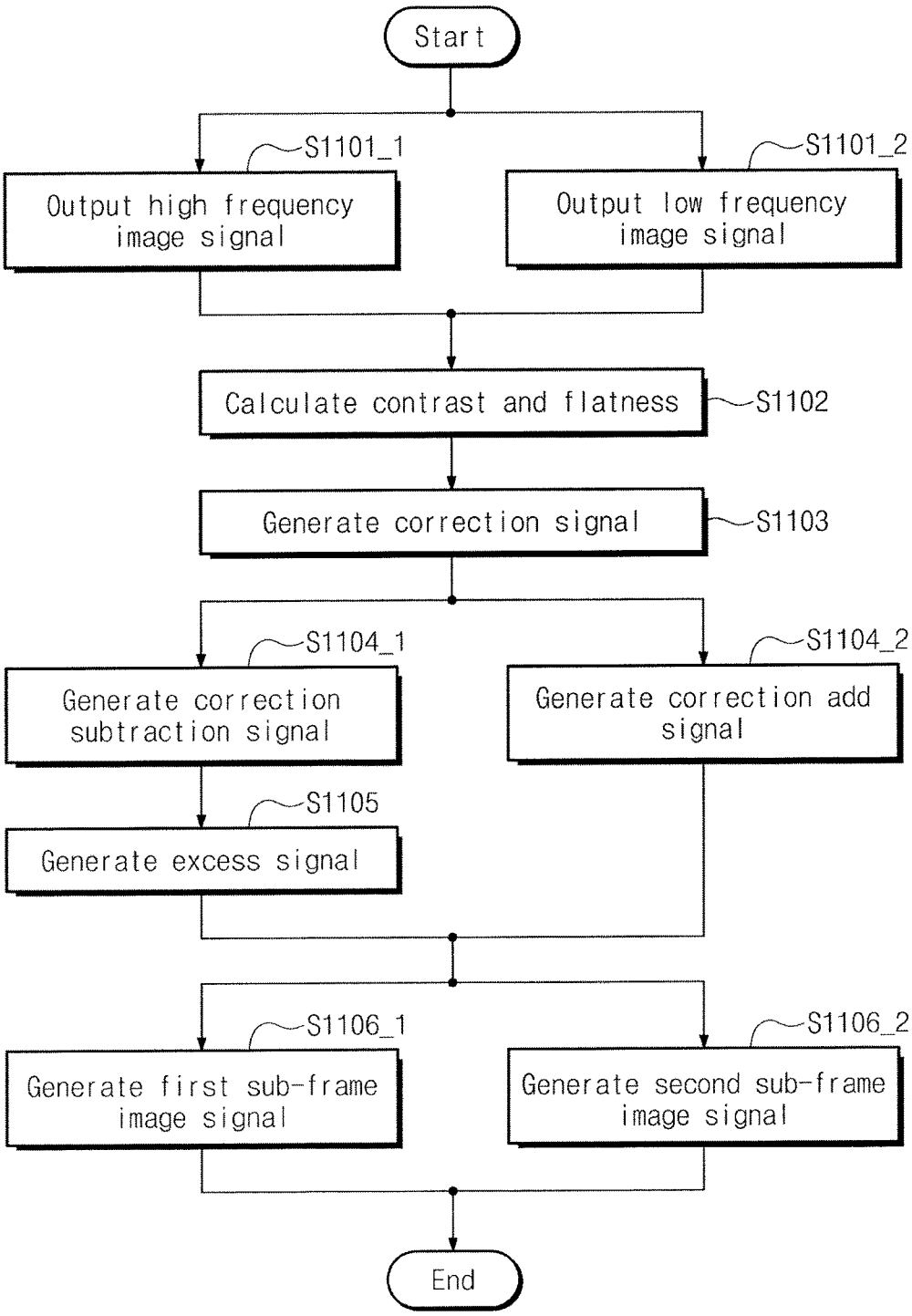
FIG. 11 illustrates another embodiment for outputting first and second sub-frame image signals.

FIG. 11 illustrates another embodiment for outputting the first and second sub-frame image signals FSIPS1 and FSIPS2.

Referring to FIGS. 2, 7A, 7B, and 11, according to this method, the correction signal AMS" may be generated prior to the excess signal OS" when compared to FIG. 10. The high frequency image signal HIS and the low frequency image signal LIS may be output through the filter unit 102 (S1101_1 and S1101_2). The contrast calculator 122 may receive the high frequency image signal HIS and calculate the contrast CTR" of the high frequency image signal HIS. The flatness calculator 123 may calculate the flatness FLN of the high frequency image signal HIS (S1102).

The correction signal generating unit 132 of the signal outputter 124" may receive the contrast CTR" of the high frequency image signal HIS, the flatness FLN" of the high frequency image signal HIS, the high frequency image signal HIS, and the low frequency image signal LIS to generate the correction signal AMS" based on the contrast CTR" of the high frequency image signal HIS, the flatness FLN" of the high frequency image signal HIS, the high frequency image signal HIS, and the low frequency image signal LIS (S1103).

The output unit 133 of the signal outputter 124" may subtract the correction signal AMS" from the high frequency image signal HIS and generate the correction subtraction signal ANS (S1104_1). The output unit 133 of the signal outputter 124" may add the correction signal AMS" to the low frequency image signal LIS to generate the correction add signal ASS (S1104_2).

The excess signal generator 121 may receive the correction subtraction signal ANS and generate the excess signal OS" through the same way as the excess signal generator 121 shown in FIG. 3A (S1105).

The subtractor 125' may subtract the excess signal OS" from the correction subtraction signal ANS to generate the first sub-frame image signal FSIPS1 (S1106_1). The first sub-frame image signal FSIPS1 is output to the signal reverse converter unit 104. The adder 126' may add the excess signal OS" to the correction add signal ASS to generate the second sub-frame image signal FSIPS2 (S1106_2). The second sub-frame image signal FSIPS2 is output to the signal reverse converter unit 104.

In addition, the filtering signal FTS' may be generated by passing the signal obtained by adding the excess signal OS" and the correction signal AMS" through the low pass filter of the filter unit 134'. Thus, the first sub-frame image signal FSIPS1' and the second sub-frame image signal FSIPS2' may be generated (e.g., as shown in FIG. 8) in an operation between operations S1105 and S1106_1 and between operations S1105 and S1106_2 in the flowchart shown in FIG. 11.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The controllers, converters, compensation units, filters, generators, generating units, calculators, outputters, substractors, adders, and other signal generating and signal processing features of the disclosed embodiments may be implemented in logic which, for example, may include hardware, software, or both. When implemented at least partially in hardware, the controllers, converters, compensation units, filters, generators, generating units, calculators, outputters, substractors, adders, and other signal generating and signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, converters, compensation units, filters, generators, generating units, calculators, outputters, substractors, adders, and other signal generating and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, various changes in form and details may be made without departing from the spirit and scope of the embodiments set forth in the claims.

What is claimed is:

1. A display device, comprising:

a display panel including a plurality of pixels; and a controller to receive a frame image signal corresponding to one frame and generate a first sub-frame image signal and a second sub-frame image signal to drive the display panel, the first sub-frame image signal and a second sub-frame image signal respectively corresponding to sub-frames divided from the one frame based on the frame image signal, the controller comprising:

a filter to output a high frequency image signal and a low frequency image signal, the high frequency image signal to be obtained by increasing a high frequency component in the frame image signal and the low frequency image signal to be obtained by decreasing the high frequency component in the frame image signal;

an excess signal generator to generate an excess signal from a portion of the high frequency image signal, in which a grayscale value is equal to or greater than a maximum allowable grayscale value, in the high frequency image signal; and a signal outputter to selectively output the first sub-frame image signal based on the excess signal and the high frequency image signal and the second sub-frame image signal based on the excess signal and the low frequency image signal.

2. The display device as claimed in claim 1, wherein the excess signal has a grayscale obtained by subtracting the maximum allowable grayscale value from the grayscale value of the portion of the high frequency image signal.

3. The display device as claimed in claim 1, wherein:

the excess signal generator is to multiply the high frequency image signal by a conversion constant and generate a high frequency intermediate signal such that a greatest grayscale value of the portion of the high frequency image signal becomes equal to the maximum allowable grayscale value, and the excess signal is obtained by subtracting the high frequency intermediate signal from the high frequency image signal.

4. The display device of as claimed in claim 1, wherein the controller includes:

a subtractor to subtract the excess signal from the high frequency image signal to generate a high frequency intermediate signal; and an adder to add the excess signal to the low frequency image signal to generate a low frequency intermediate signal, wherein the signal outputter is to output the first sub-frame image signal based on the high frequency intermediate signal and output the second sub-frame image signal based on the low frequency intermediate signal.

5. The display device as claimed in claim 4, wherein the controller includes:

a contrast calculator to calculate a contrast of the frame image signal based on the high frequency intermediate signal and the low frequency intermediate signal; and a flatness calculator to calculate a flatness of the high frequency intermediate signal, and wherein the signal outputter includes:

a critical look-up table to store a critical contrast value corresponding to the flatness, a correction signal generator to generate a correction signal based on the excess signal and the critical contrast value corresponding to the flatness of the high frequency intermediate signal when the contrast of the frame image signal is greater than the critical contrast value stored in the critical look-up table and corresponding to the flatness of the high frequency intermediate signal, and an output to subtract the excess signal and the correction signal from the high frequency image signal to generate the first sub-frame image signal, and to add the excess signal and the correction signal to the low frequency image signal to generate the second sub-frame image signal.

6. The display device as claimed in claim 5, wherein the correction signal generator is to generate the correction signal by the following formula:

$$\beta = \frac{H - L - (H + L)Clim - 2\alpha}{2},$$

where β denotes the correction signal, H denotes the high frequency image signal, L denotes the low frequency image signal, Clim denotes the critical contrast corresponding to the flatness of the high frequency intermediate signal, and a denotes the excess signal.

7. The display device as claimed in claim 5, wherein the contrast calculator is to calculate the contrast of the frame image signal by the following formula:

$$C = \frac{(H - \alpha) - (L + \alpha)}{(H - \alpha) + (L + \alpha)},$$

where C denotes the contrast of the frame image signal, H denotes the high frequency image signal, L denotes the low frequency image signal, and a denotes the excess signal.

8. The display device as claimed in claim 5, wherein the flatness of the high frequency intermediate signal corresponds to a number of pixels, among the plurality of pixels, in which a grayscale value of the high frequency intermediate signal is equal to or smaller than a predetermined reference value.

9. The display device as claimed in claim 1, wherein the controller includes:

a subtractor to subtract the excess signal from the high frequency image signal to generate a high frequency intermediate signal;

an adder to add the excess signal to the low frequency image signal to generate a low frequency intermediate signal;

a contrast calculator to calculate a contrast of the frame image signal based on the high frequency intermediate signal and the low frequency intermediate signal; and a flatness calculator to calculate a flatness of the high frequency intermediate signal, and wherein the signal outputter includes:

a critical look-up table to store a critical contrast value corresponding to the flatness, a correction signal generator to generate a correction signal based on the excess signal and the critical contrast value corresponding to the flatness of the high frequency intermediate signal when the contrast of the frame image signal is greater than the critical contrast value, stored in the critical look-up table, corresponding to the flatness of the high frequency intermediate, a filter to output a filtering signal obtained by low-pass filtering a signal obtained by adding the excess signal and the correction signal, and an output to subtract the filtering signal from the high frequency image signal to generate the first sub-frame image signal and add the filtering signal to the low frequency image signal to generate the second sub-frame image signal.

10. A method for driving a display device, comprising:

receiving a frame image signal corresponding to one frame; and generating a first sub-frame image signal and a second sub-frame image signal to drive a display panel including a plurality of pixels, the first sub-frame image signal and the second sub-frame image respectively corresponding to sub-frames divided from the one frame based on the frame image signal, wherein the generating the first sub-frame image signal and the second sub-frame image signal includes:

increasing a high frequency component in the frame image signal to output a high frequency image signal;

decreasing the high frequency component in the frame image signal to output a low frequency image signal;

generating an excess signal from a portion of the high frequency image signal, in which a grayscale value is equal to or greater than a maximum allowable grayscale value, in the high frequency image signal;

outputting the first sub-frame image signal based on the excess signal and the high frequency image signal; and outputting the second sub-frame image signal based on the excess signal and the low frequency image signal.

11. The method as claimed in claim 10, wherein the excess signal has a grayscale obtained by subtracting the maximum allowable grayscale value from the grayscale value of the portion of the high frequency image signal.

12. The method as claimed in claim 10, wherein:

generating the first sub-frame image signal and the second sub-frame image signal includes multiplying the high frequency image signal by a conversion constant and generating a high frequency intermediate signal, such that a greatest grayscale value of the portion of the high frequency image signal becomes equal to the maximum allowable grayscale value, and the excess signal is obtained by subtracting the high frequency intermediate signal from the high frequency image signal.

13. The method as claimed in claim 10, wherein:

generating the first sub-frame image signal and the second sub-frame image signal includes:

subtracting the excess signal from the high frequency image signal to generate a high frequency intermediate signal; and adding the excess signal to the low frequency image signal to generate a low frequency intermediate signal, wherein the first sub-frame image signal is output based on the high frequency intermediate signal in outputting the first sub-frame image signal based on the excess signal and the high frequency image signal, and wherein the second sub-frame image signal is output based on the low frequency intermediate signal in outputting the second sub-frame image signal based on the excess signal and the low frequency image signal.

14. The method as claimed in claim 13, wherein generating the first sub-frame image signal and the second sub-frame image signal includes:

calculating a contrast of the frame image signal based on the high frequency intermediate signal and the low frequency intermediate signal;

calculating a flatness of the high frequency intermediate signal; and generating a correction signal based on the excess signal and a critical contrast corresponding to the flatness of the high frequency intermediate signal when the contrast of the frame image signal is greater than the critical contrast corresponding to the flatness of the high frequency intermediate signal in a critical look-up table, wherein the first sub-frame image signal is output by subtracting the excess signal and the correction signal from the high frequency image signal in the outputting of the first sub-frame image signal based on the excess signal and the high frequency image signal, and wherein the second sub-frame image signal is output by adding the excess signal and the correction signal to the low frequency image signal in the outputting of the second sub-frame image signal based on the excess signal and the low frequency image signal.

15. The method as claimed in claim 14, wherein the correction signal is generated by the following formula:

$$\beta = \frac{H - L - (H + L)Clim - 2\alpha}{2},$$

where β denotes the correction signal, H denotes the high frequency image signal, L denotes the low frequency image signal, Clim denotes the critical contrast corresponding to the flatness of the high frequency intermediate signal, and a denotes the excess signal.

16. The method as claimed in claim 14, wherein the contrast of the frame image signal is calculated by the following formula:

$$C = \frac{(H-\alpha)-(L+\alpha)}{(H-\alpha)+(L+\alpha)},$$

where C denotes the contrast of the frame image signal, H denotes the high frequency image signal, L denotes the low frequency image signal, and a denotes the excess signal.

17. The method as claimed in claim 10, wherein generating the first sub-frame image signal and the second sub-frame image signal includes:

subtracting the excess signal from the high frequency image signal to generate a high frequency intermediate signal;

adding the excess signal to the low frequency image signal to generate a low frequency intermediate signal;

calculating a contrast of the frame image signal based on the high frequency intermediate signal and the low frequency intermediate signal;

calculating a flatness of the high frequency intermediate signal;

generating a correction signal based on the excess signal and a critical contrast corresponding to the flatness of the high frequency intermediate signal when the contrast of the frame image signal is greater than the critical contrast corresponding to the flatness of the high frequency intermediate signal in a critical look-up table storing the critical contrast corresponding to the flatness; and outputting a filtering signal obtained by low-pass filtering a signal obtained by adding the excess signal and the correction signal, wherein the first sub-frame image signal obtained by subtracting the filtering signal from the high frequency image signal is output in the outputting of the first sub-frame image signal based on the excess signal and the high frequency image signal, and wherein the second sub-frame image signal obtained by adding the filtering signal to the low frequency image signal is output in the outputting of the second sub-frame image signal based on the excess signal and the low frequency image signal.

18. A method for driving a display device, comprising:

receiving a frame image signal corresponding to one frame; and generating a first sub-frame image signal and a second sub-frame image signal to drive a display panel including a plurality of pixels, the first sub-frame image signal and the second sub-frame image signal respectively corresponding to sub-frames divided from the one frame based on the frame image signal, wherein generating of the first sub-frame image signal and the second sub-frame image signal includes:

increasing a high frequency component in the frame image signal to output a high frequency image signal;

decreasing the high frequency component in the frame image signal to output a low frequency image signal;

calculating a contrast of the frame image signal based on the high frequency image signal and the low frequency image signal;

calculating a flatness of the high frequency image signal;

generating a correction signal based on a critical contrast corresponding to the flatness of the high frequency image signal when the contrast of the frame image signal is greater than the critical contrast corresponding to the flatness of the high frequency image signal in a critical look-up table storing the critical contrast corresponding to the flatness; and outputting the first sub-frame image signal based on the correction signal and the high frequency image signal; and outputting the second sub-frame image signal based on the correction signal and the low frequency image signal.

19. The method as claimed in claim 18, wherein generating the first sub-frame image signal and the second sub-frame image signal includes:

generating an excess signal from a portion of a correction subtraction signal, in which a grayscale value is equal to or greater than a maximum allowable grayscale value, obtained by subtracting the correction signal from the high frequency image signal, wherein the first sub-frame image signal is obtained by subtracting the correction signal and the excess signal from the high frequency image signal output based on the correction signal and the high frequency image signal, and wherein the second sub-frame image signal is obtained by adding the correction signal and the excess signal to the low frequency image signal output based on the correction signal and the low frequency image signal.

20. The method as claimed in claim 19, wherein generating the first sub-frame image signal and the second sub-frame image signal includes:

outputting a filtering signal obtained by low-pass filtering a signal obtained by adding the excess signal and the correction signal, wherein the first sub-frame image signal is obtained by subtracting the filtering signal from the high frequency image signal output based on the correction signal and the high frequency image signal, and wherein the second sub-frame image signal obtained by adding the filtering signal to the low frequency image signal output based on the correction signal and the low frequency image signal.

* * * * *